US007402766B1

(12) United States Patent
Jonas et al.

(10) Patent No.: US 7,402,766 B1
(45) Date of Patent: Jul. 22, 2008

(54) PANEL TRANSFER SWITCH

(76) Inventors: Jeffrey J. Jonas, W238 S5400 Chestnut Dr., Waukesha, WI (US) 53066; Gary D. Wendegatz, 1128 White Sands Ct., West Bend, WI (US) 53090; Andrew D. Schill, 10345 W. Plum Tree Cir., Hales Corners, WI (US) 53130; Andrew P. Sibrel, 487 River Bluff Cir., Oconomowoc, WI (US) 53066; Francis X. Wedel, 370 S. Ferry Dr., Lake Mills, WI (US) 53551

( * ) Notice: Subject to any disclaimer, the term of this patent is extended or adjusted under 35 U.S.C. 154(b) by 0 days.

(21) Appl. No.: 11/784,955

(22) Filed: Apr. 10, 2007

(51) Int. Cl.
*H01H 9/26* (2006.01)

(52) U.S. Cl. ..... 200/50.33; 307/64

(58) Field of Classification Search ... 200/50.32–50.35, 200/50.37, 50.39, 50.4; 307/64
See application file for complete search history.

(56) References Cited

U.S. PATENT DOCUMENTS 3,778,633 A * 12/1973 DeVisser et al. ..... 307/64
4,398,097 A * 8/1983 Schell et al. ..... 307/64
4,760,278 A * 7/1988 Thomson ..... 307/64
4,999,598 A * 3/1991 Jannesari et al. ..... 335/122
5,576,604 A * 11/1996 Kunert et al. ..... 318/135
5,761,027 A * 6/1998 Flegel ..... 361/664
6,100,604 A * 8/2000 Morroni et al. ..... 307/64
6,815,624 B2 * 11/2004 Schultz ..... 200/50.33
7,126,068 B2 * 10/2006 Fillppenko ..... 200/50.33

* cited by examiner

*Primary Examiner*—Michael A Friedhofer
(74) *Attorney, Agent, or Firm*—Boyle Fredrickson, S.C.

(57) ABSTRACT

A transfer switch is provided for transferring the supply of electrical power to a load between a utility source and a generator that generates electrical power when started. The load is interconnected to the utility source through a first circuit breaker and to the generator through a second circuit breaker. Each circuit breaker is movable between an on position and an off position. The transfer switch includes a first arm movable between a first position and a second position wherein the first arm is engageable with the first circuit breaker for moving the first circuit breaker from the off position to the on position. A second arm is movable between a first position and a second position engageable with the second circuit breaker for moving the second circuit breaker from the off position to the on position. A control structure selectively urges the first and second arms to the second positions.

24 Claims, 10 Drawing Sheets

PANEL TRANSFER SWITCH

FIELD OF THE INVENTION

This invention relates generally to stand-by electrical generators, and in particular, to a transfer switch connectable to a circuit breaker panel for transferring the supply of electrical power to essential devices in a residential home between a utility source and a stand-by electrical generator.

BACKGROUND AND SUMMARY OF THE INVENTION

As is known, virtually all residential homes utilize electrical power received from a utility company. Typically, utility companies have an excellent record of providing uninterrupted or infrequently interrupted power to their customers at proper voltage levels and line frequency. However, due to the increasing demand for power, power outages have become more frequent. While power outages usually last only for a short duration, an extended power outage may cause more than simple aggravation for customers of the utility. A power outage may render a homeowner's appliances, such as the sump pump, refrigerator or freezer inoperable. If a power outage occurs during a rainstorm, the failure of the sump pump to operate may result in the flooding of the homeowner's basement.

In order to combat these occasional disruptions in service, many residential customers of the utility companies have equipped their homes with stand-by electrical generator systems. These stand-by electrical generator systems include internal combustion engines that drive electrical generators. If the commercial power from the utility company fails, the internal combustion engine of the stand-by electrical generator system is automatically started causing the electrical generator to generate electrical power. When the electrical power generated by the electrical generator reaches the proper voltage and frequency desired by the customer, a transfer mechanism transfers the load imposed by the homeowner from the commercial power lines to the electrical generator.

Typically, the transfer mechanism incorporates switches that isolate the electrical power supplied by the utility company from the generator. In a residential application, the switches are flipped either manually or automatically between the utility source and the generator in order to provide power to the electrical system of the home. These prior art transfer mechanisms often require a homeowner to transfer the entire electrical system of the home onto the generator. Such an arrangement does not provide the homeowner with the ability to decide which circuits of the home's electrical system are to be powered. It can be appreciated that the demands of the entire electrical system of the home can be quite significant. As a result, the generator must be of sufficient size to power the entire electrical system of the home. This, in turn, increases the overall cost of the stand-by electrical generator system for the homeowner.

Therefore, it is a primary object and feature of the present invention to provide a transfer switch that transfers the electrical power supplied to essential devices within a residential home between a utility source and stand-by electrical generator.

It is a further object and feature of the present invention to provide a transfer switch that automatically transfers the electrical power supplied to essential devices within a residential home from a utility source to a stand-by electrical generator in response to a power outage.

It is a still further object and feature of the present invention to provide a transfer switch for transferring the electrical power supplied to essential devices within a residential home between a utility source and a stand-by electrical generator that may be simply and easily installed.

In accordance with the present invention, a transfer switch is provided. The transfer switch transfers the supply of electrical power to a load between a utility source and a generator that generates electrical power when started. The load is interconnected to the utility source through a first circuit breaker and to the generator through a second circuit breaker. Each circuit breaker is movable between an on position and an off position. The transfer switch includes a first arm movable between a first position and a second position wherein the first arm is engageable with the first circuit breaker for moving the first circuit breaker from the off position to the on position. A second arm is movable between a first position and a second position engageable with the second circuit breaker for moving the second circuit breaker from the off position to the on position. A control structure selectively urges the first and second arms to the second positions.

A bar extends between the first and second circuit breakers. The bar moves the second circuit breaker to the off position when the first circuit breaker moves to the on position and moves the first circuit breaker to the off position when the second circuit breaker moves to the on position.

The control structure includes a rotatable arm selectively engageable with one of the first and second arms to move the one of the first and second arms to the second position. The rotatable arm is also axially movable between a retracted position and an extended position. The control structure includes a biasing structure for urging the rotating arm towards the extended position. The rotating arm includes a terminal end and a bearing rotatably mounted to the terminal end of the rotating arm. The bearing is engageable with the first and second arms. The control structure also includes a motor operatively connected to the rotatable arm for rotating the arm and a controller operatively connected to the generator. The controller actuates the motor in response to a command from the generator. The controller also includes first and second switches movable between off positions and on positions. The positions of the switches control actuation of the motor.

The control structure further includes a cam disk disposed between the rotating arm and the first and second switches. The cam disk has a first camming surface engageable with the first switch for actuating the first switch and a second camming surface engageable with the second switch for actuating the second switch.

In accordance with a further aspect of the present invention, a transfer switch is provided for transferring the supply of electrical power to a load between a utility source and a generator that generates electrical power when started. The load is interconnected to the utility source through a first circuit breaker and to the generator through a second circuit breaker. Each circuit breaker is movable between an on position and an off position. The transfer switch includes a first arm movable between a first position and a second position wherein the first arm is engageable with the first circuit breaker for moving the first circuit breaker from the off position to the on position. A second arm is movable between a first position and a second position engageable with the second circuit breaker for moving the second circuit breaker from the off position to the on position. A bar extends between the first and second circuit breakers. The bar moves the second circuit breaker to the off position when the first circuit breaker moves to the on position and moves the first circuit breaker to the off position when the second circuit breaker moves to the on position.

A rotatable arm is selectively engageable with one of the first and second arms to move the one of the first and second arms to the second position. In addition, the rotatable arm is axially movable between a retracted position and an extended position. A biasing structure urges the rotatable arm towards the extended position. The terminal end of the rotatable arm includes a bearing rotatably mounted thereto. The bearing is engageable with the first and second arms.

A motor is operatively connected to the rotatable arm for rotating arm and a controller is operatively connected to the generator. The controller actuates the motor in response to a command from the generator. The controller includes first and second switches movable between off positions and on positions. The positions of the switches control actuate the motor. A cam disk is disposed between the rotatable arm and the first and second switches. The cam disk includes a first camming surface engageable with the first switch for actuating the first switch and a second camming surface engageable with the second switch for actuating the second switch.

In accordance with a still further aspect of the present invention, a transfer switch is provided for transferring the supply of electrical power to a load between a utility source and a generator that generates electrical power when started. The load is interconnected to the utility source through a first circuit breaker and to the generator through a second circuit breaker. Each circuit breaker is movable between an on position and an off position. The transfer switch includes a first arm movable between a first position and a second position wherein the first arm is engageable with the first circuit breaker for moving the first circuit breaker from the off position to the on position. A second arm is movable between a first position and a second position engageable with the second circuit breaker for moving the second circuit breaker from the off position to the on position. A rotatable arm selectively engages one of the first and second arms to move the one of the first and second arms to the second position. A motor is operatively connected to rotatable arm for rotating the arm. A motor control is operatively connected to the motor for actuating the motor and an actuation element is operatively connected to the rotatable arm. The actuation element communicates with the motor control for controlling actuation of the motor.

A bar extends between the first and second circuit breakers. The bar moves the second circuit breaker to the off position when the first circuit breaker moves to the on position and moves the first circuit breaker to the off position when the second circuit breaker moves to the on position. The rotating arm is axially movable between a retracted position and an extended position. A biasing structure urges the rotating arm towards the extended position. The rotating arm also includes a terminal end and a bearing rotatably mounted to the terminal end of the rotating arm. The bearing is engageable with the first and second arms. First and second switches are operatively connected to the motor control and are movable between off positions and on positions. The positions of the switches control actuation of the motor. The actuation element includes at least one camming surface engageable with at least one switch for moving the at least one switch between the off position and the on position.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE INVENTION

Figure 1:
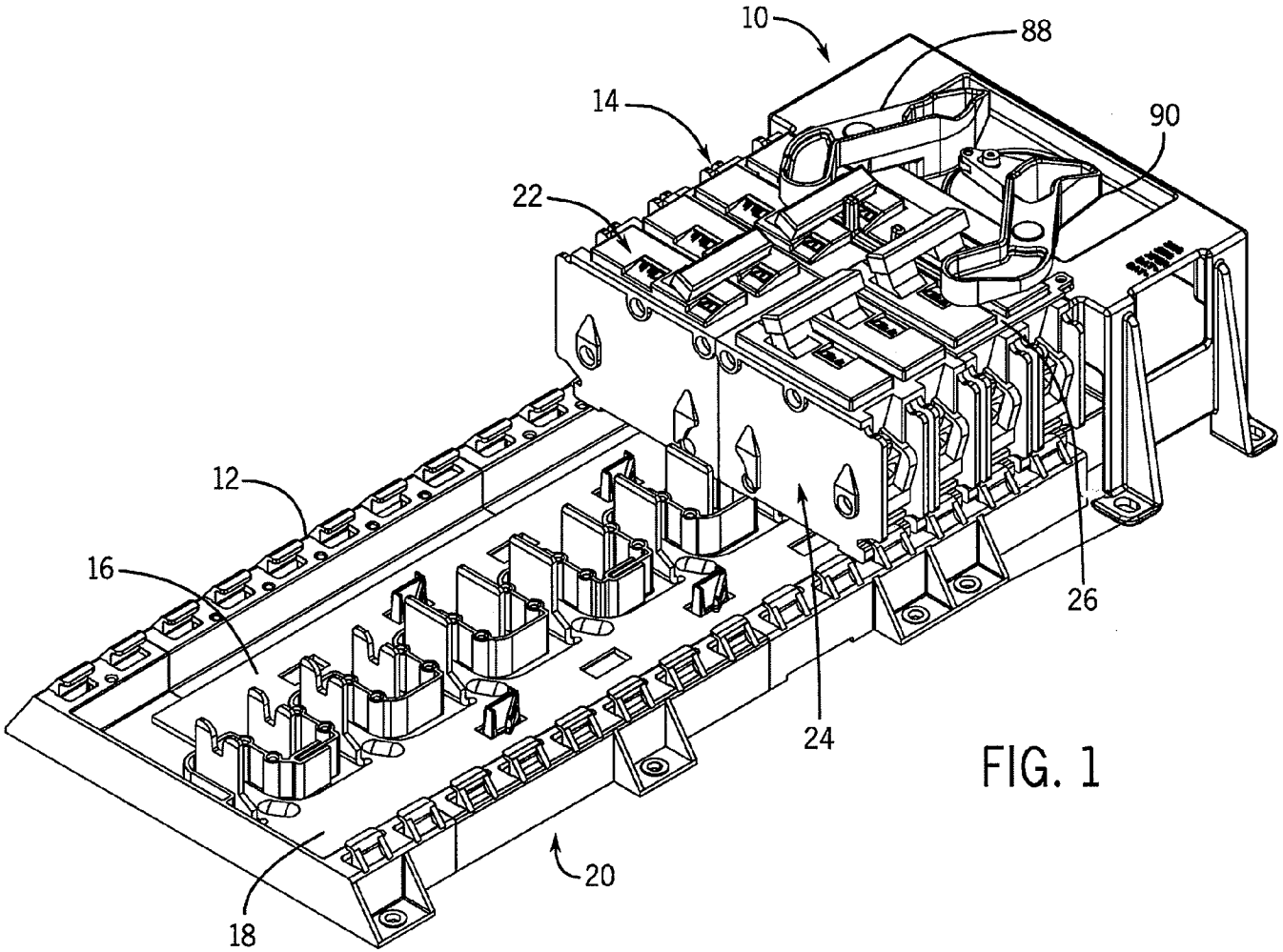
FIG. 1 is an isometric plan view of a circuit breaker panel incorporating a transfer switch in accordance with the present invention.
Figure 2:
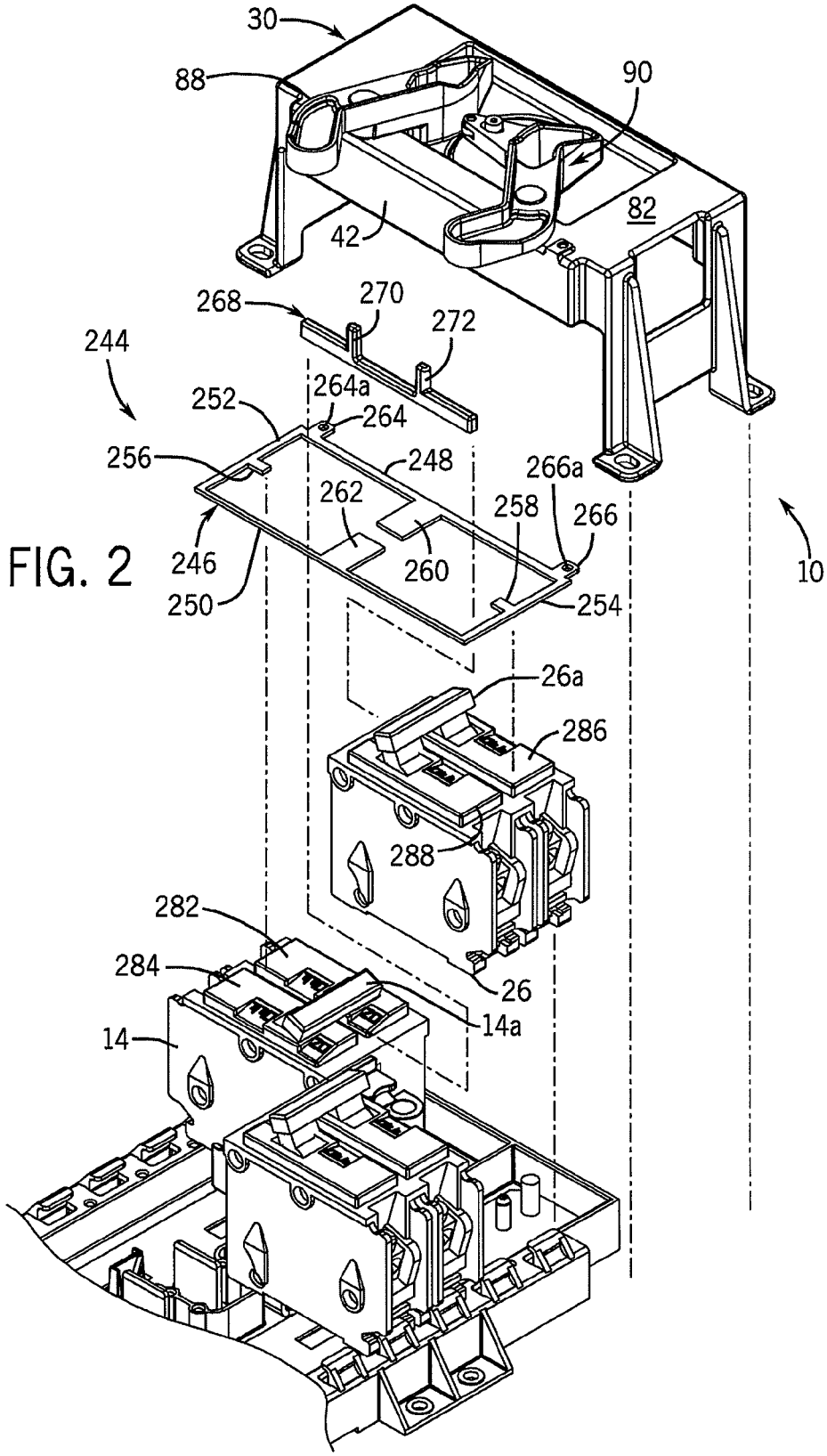
FIG. 2 is a partially exploded view of the circuit breaker panel and the transfer switch in accordance with the present invention.
Figure 3:
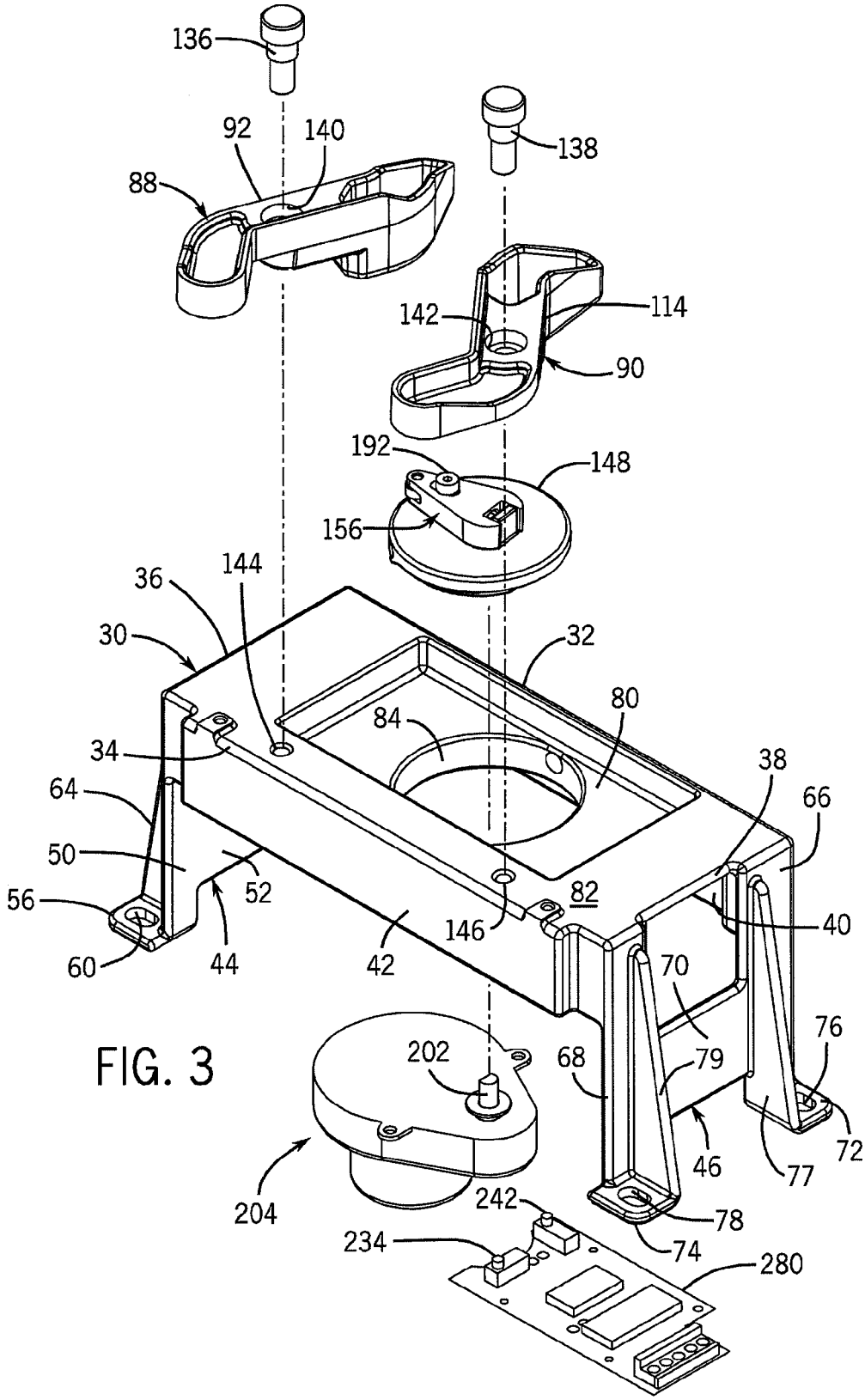
FIG. 3 is an exploded view of the transfer switch of the present invention.

Referring to FIGS. 1-3, a transfer switch in accordance with the present invention is generally designated by the reference numeral 10. It is contemplated that transfer switch 10. It is intended for transfer switch to be mounted on circuit breaker panel 12. As is conventional, three utility service lines come into the upper portion of panel 12. The three utility service lines include two "hot" lines and a neutral service line. The two hot lines are attached two-gang main circuit breaker that, in turn, are connected to first and second hot non-essential buss bars. The neutral service line is connected to a neutral buss bar. Circuit breaker panel 12 may also include a ground buss bar, interconnected to the neutral buss bar. A plurality of circuit breakers interconnect each hot non-essential buss bar to corresponding non-essential branch circuits of a building's electrical wiring.

In the present invention, it is contemplated to interconnect first and second hot non-essential buss bars to corresponding first and second essential hot buss bars 16 and 18, respectively, disposed in lower portion 20 of panel 12 through two-pole circuit breaker 14. Various individual branch circuits of the building's electrical wiring connected preferably to corresponding essential electrically powered devices are coupled to first and second essential hot buss bars 16 and 18, respectively, through corresponding circuit breakers, e.g. circuit breakers 22 and 24. In addition, the output of a conventional standby electrical generator (not shown) is interconnected to first and second essential hot buss bars 16 and 18, respectively, disposed in lower portion 20 of panel 12 through two-pole circuit breaker 26. The standby electrical generator monitors the power supplied by the utility source. In response to a power outage from the utility source, the standby electrical generator starts the engine of the generator. The starting of the engine causes the generator to generate electrical power at the output thereof, for reasons hereinafter described.

With circuit breaker 14 in the on position, electricity may flow from the utility, through the first and second non-essential hot buss bars and circuit breaker 14 to the first and second essential hot buss bars 16 and 18, respectively. As a result, various essential branch circuits of the buildings electrical wiring may be supplied with electrical power from the utility source. With circuit breaker 14 in the off position, the first and second essential hot buss bars 16 and 18, respectively, are isolated from the first and second non-essential hot buss bars, and hence, from the utility source. With circuit breaker 26 in the on position, electricity may flow from the standby electrical generator through circuit breaker 26 to the first and second essential hot buss bars 16 and 18, respectively. As a result, various essential branch circuits of the buildings electrical wiring may be supplied with electrical power from the generator. With circuit breaker 26 in the off position, the first and second essential hot buss bars 16 and 18, respectively, are isolated from the standby electrical generator.

Figure 7:
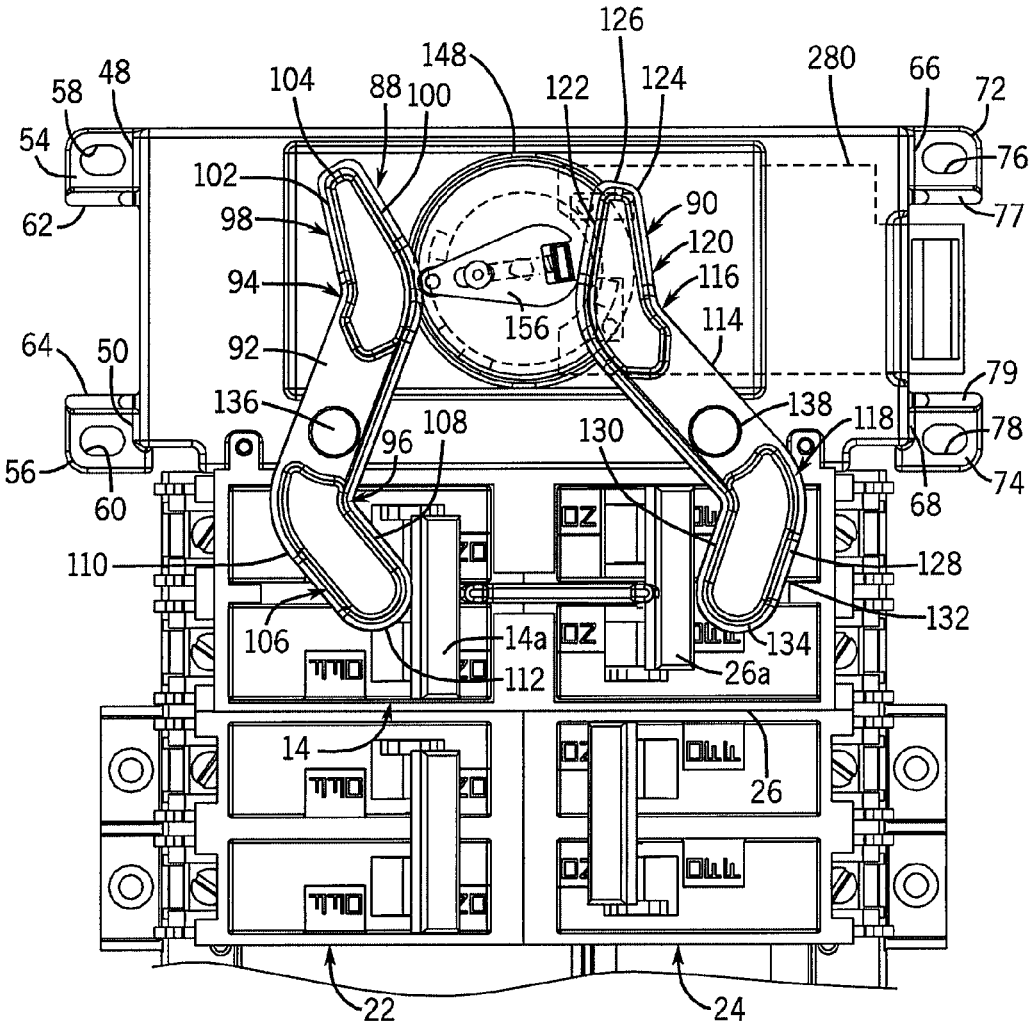
FIG. 7 is a top plan view of the circuit breaker panel of FIG. 1 showing the transfer switch in a first position.
Figure 8:
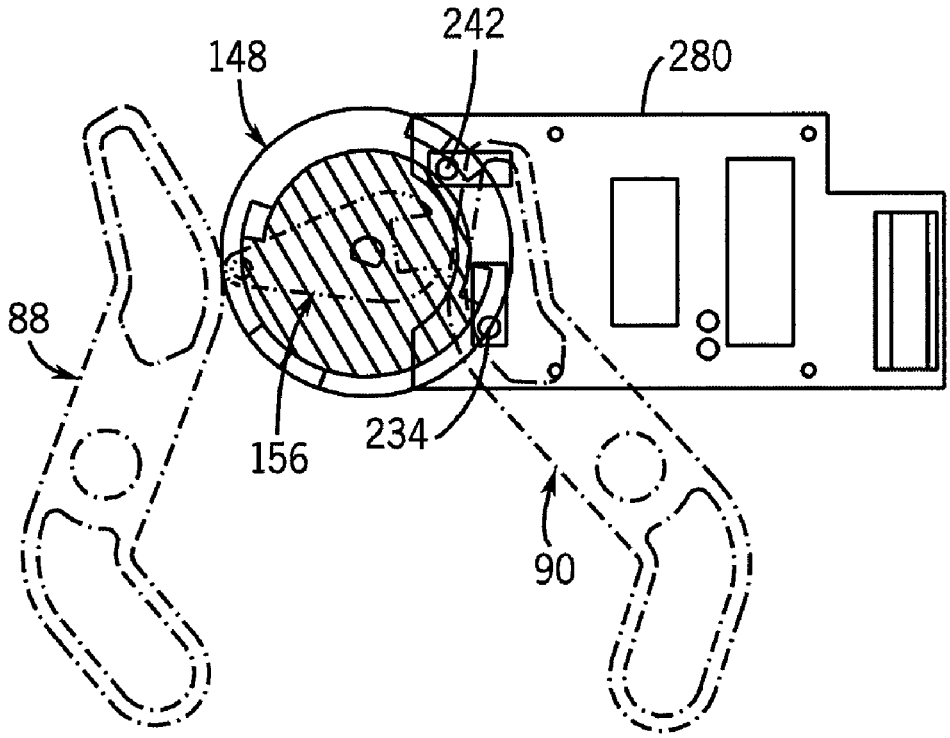
FIG. 8 is a top plan view, partially in phantom, showing the transfer switch in the first position.
Figure 9:
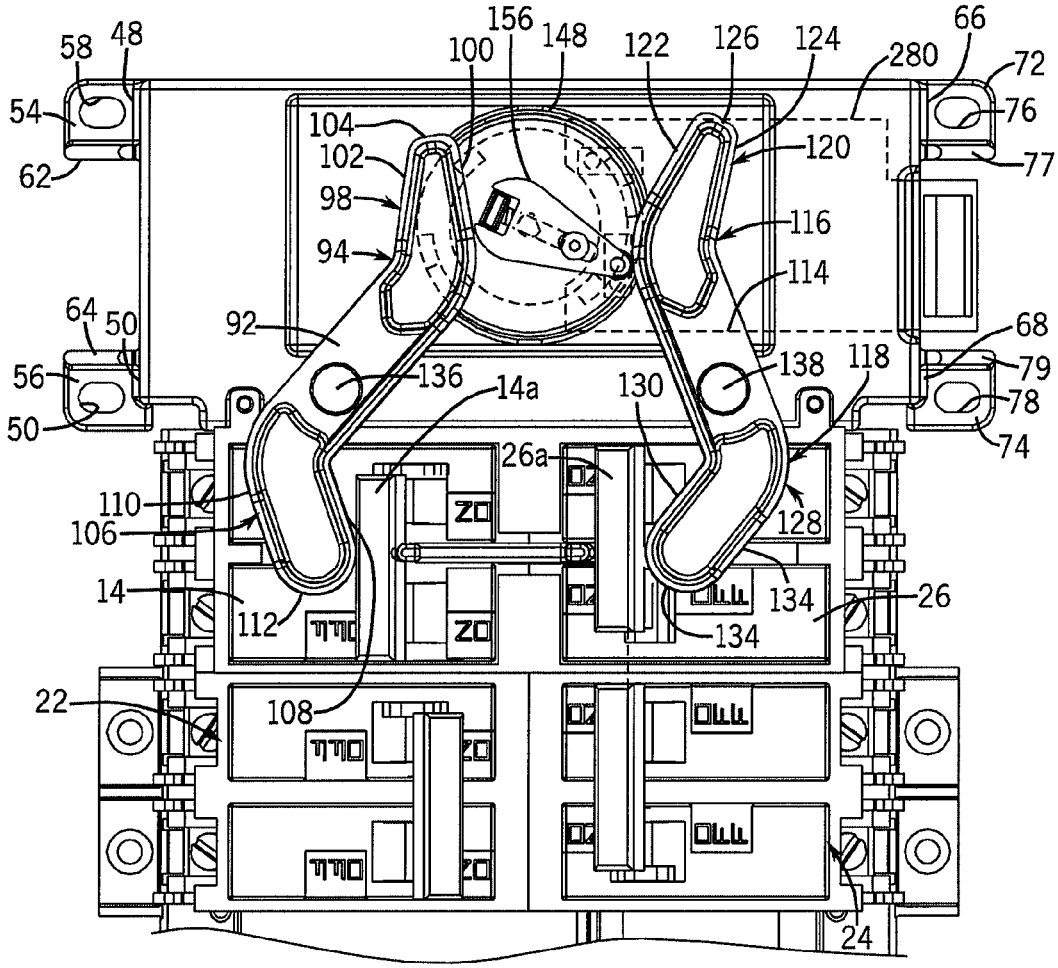
FIG. 9 is a top plan view of the circuit breaker panel of FIG. 1 showing the transfer switch in a second position.
Figure 10:
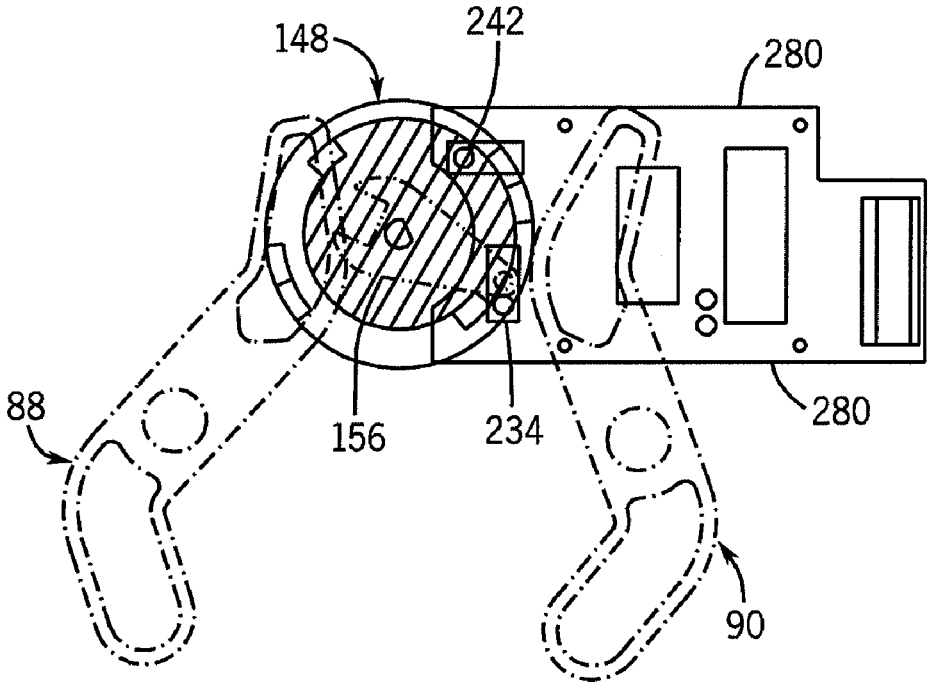
FIG. 10 is a top plan view, partially in phantom, showing the transfer switch in the second position.

As best seen in FIGS. 2-3, transfer switch 10 includes base 30 having first and second sides 32 and 34, respectively, and first and second ends 36 and 38, respectively. Sidewalls 40 and 42, respectively, depend from corresponding first and second sides 32 and 34, respectively, of base 30, for reasons after described. First and second leg structures 44 and 46, respectively, depend from corresponding first and second ends 36 and 38, respectively, of base 30. Leg structure 44 includes first and second generally flat walls 48 and 50, respectively, FIGS. 7 and 9, interconnected by cross-support 52. Feet 54 and 56 are provided on the terminal ends of corresponding walls 48 and 50 of leg structure 44. Each foot 54 and 56 is generally perpendicular to walls 48 and 50, respectively, and includes a corresponding aperture 58 and 60, respectively, therethrough. Gussets 62 and 64 extend between the upper surfaces of feet 54 and 56, respectively, and corresponding first and second walls 48 and 50, respectively, of leg structure 44. Leg structure 46 includes first and second generally flat walls 66 and 68, respectively, interconnected by cross-support 70. Feet 72 and 74 are provided on the terminal ends of corresponding walls 66 and 68 of leg structure 46. Each foot 72 and 74 is generally perpendicular to walls 66 and 68, respectively, and includes a corresponding aperture 76 and 78, respectively, therethrough. Gussets 77 and 79 extend between the upper surfaces of feet 2 and 74, respectively, and corresponding first and second walls 66 and 68, respectively, of leg structure 46.

Base 30 further includes recessed surface 80 in upper surface 82 thereof. Opening 84 extends through recessed surface 80 is dimensioned to rotatably support cam assembly 86 therein. First and second generally S-shaped operating arms 88 and 90, respectively, are pivotally mounted to base 30. As best seen in FIGS. 7-10, operating arm 88 includes central portion 92 having first and second opposite ends 94 and 96, respectively. First leg 98 extends from first end 94 of central portion 92 of operating arm 88 and is defined by first and second sides 100 and 102, respectively, which converge towards and interconnected by terminal end 104. Second leg 106 extends from second end 96 of central portion 92 of operating arm 88 and is defined by first and second sides 108 and 110, respectively, interconnected by a generally actuate terminal end 112. Similarly, operating arm 90 includes central portion 114 having first and second opposite ends 116 and 118, respectively. First leg 120 extends from first end 116 of central portion 114 of operating arm 90 and is defined by first and second sides 122 and 124, respectively, which converge towards and interconnected by terminal end 126. Second leg 128 extends from second end 118 of central portion 114 of operating arm 90 and is defined by first and second sides 130 and 132, respectively, interconnected by a generally actuate terminal end 134. First and second operating arms 88 and 90, respectively, are pivotally connected to base 30 by corresponding pivot pins 136 and 138. As best seen in FIG. 3, pivot pins 136 and 138 extend through corresponding apertures 140 and 142 in central portions 92 and 114 of first and second operation arms 88 and 90, respectively, and into apertures 144 and 146 in base 30.

Figure 4:
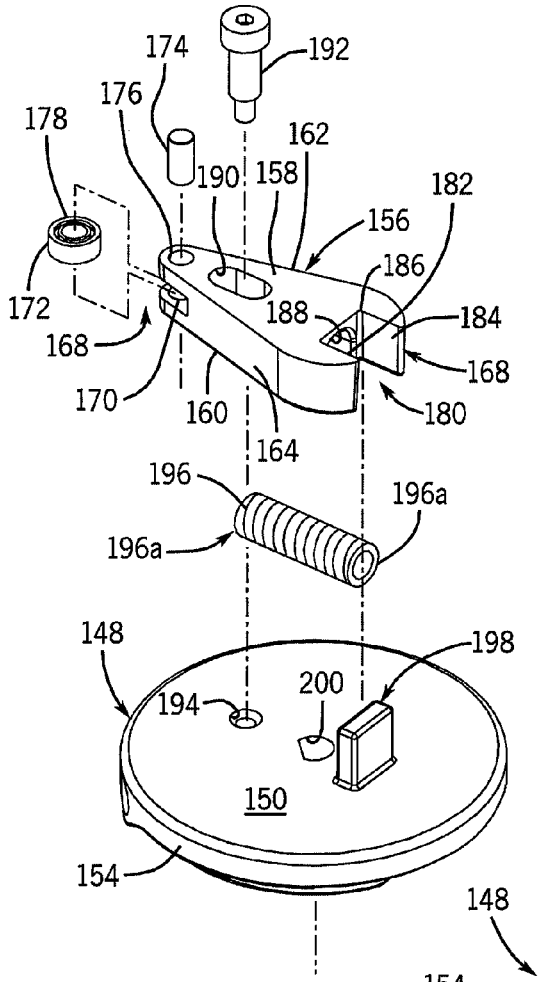
FIG. 4 is an exploded view of an actuator of the transfer switch of the present invention.
Figure 5:
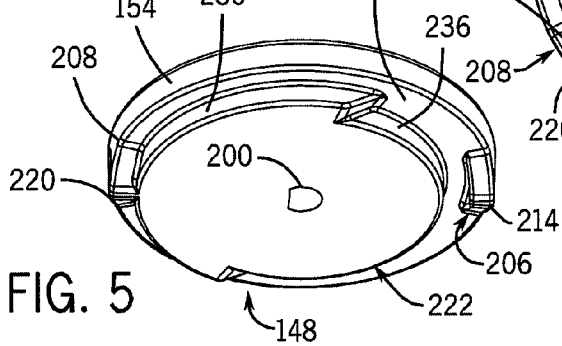
FIG. 5 is an isometric view of a cam for the actuator of the transfer switch of the present invention.
Figure 6:
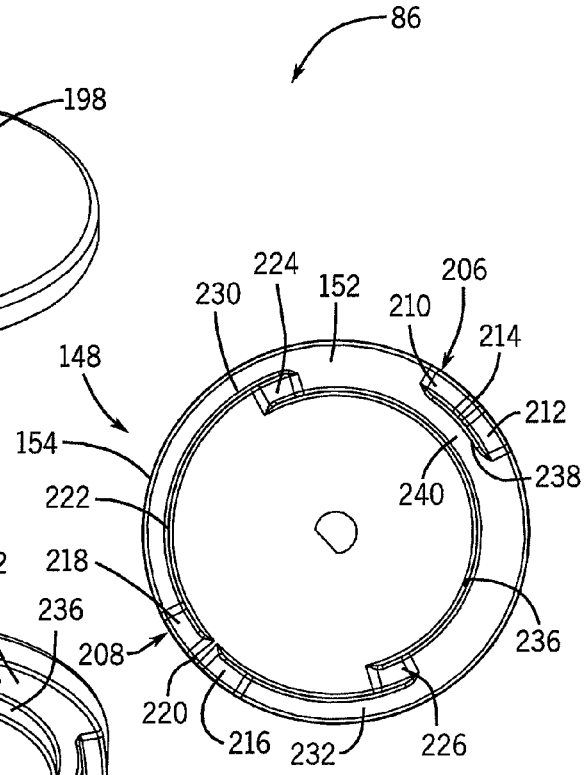
FIG. 6 is a bottom plan view of the cam of FIG. 5.

Referring to FIGS. 4-6, cam assembly 86 includes cam disk 148 having upper surface 150 and lower surface 152 interconnected by outer periphery 154. Arm 156 is supported on upper surface 150 of cam disk 148 is defined by upper and lower surfaces 158 and 160, respectively, interconnected by first and second sides 162 and 164, respectively. First and second sides 162 and 164, respectively, are interconnected by first and second ends 166 and 168, respectively. First end 166 of arm 156 is generally actuate and includes recess 170 formed therein. Recess 170 is dimensioned for receiving generally circular bearing 172 therein. Bearing 172 is rotatably supported on dowel pin 174 that extends through aperture 176 in arm 156 adjacent first end 166 and through central aperture 178 in bearing 172. Second end 168 of arm 156 is generally actuate and includes recess 180 formed therein. Recess 180 is defined by sidewalls 182 and 184 interconnected by end wall 186. Spring receipt passageway 188 is formed in end wall 186 and has a first end communicating with recess 180 and a second end communicating with oblong aperture 190 extending between upper and lower surfaces 158 and 160, respectively, of arm 156.

Arm 156 is interconnected to upper surface 150 of cam disk 148 by screw 192. Screw 192 extends through oblong aperture 190 in arm 156 and into opening 194 in upper surface 150 of cam disk 148. As a sample configuration, it can be appreciated that arm 156 is slideable along screw 192 between an extended position and a retracted position defined by the opposite ends of oblong aperture 190. Spring 196 is disposed within spring receipt passageway 188 in arm 156 and includes first end **196*a* in engagement with screw 192 and second, opposite end 196*b* in engagement with wall 198 projecting vertically from upper surface 150 of cam disk 148. Spring 196 urges arm 156** towards its extended position.

Cam disk 148 further includes a generally semi-circular aperture 200 extending between upper and lower surfaces 150 and 152, respectively, thereof. Aperture 200 is adapted to receive drive shaft 202 of motor 204. Lower surface 152 in cam disk 148 includes outer camming elements 206 and 208 projecting therefrom. Outer camming elements 206 and 208 are a predetermined radial distance from the center of cam disk 148 and are circumferentially spaced from each other. Outer camming element 206 includes first and second camming surfaces 210 and 212 projecting from lower surface 152 of cam disk 148 and converging toward each other. Camming surfaces 210 and 212 converge at and are interconnected by apex 214. Similarly, camming element 208 includes first and second camming surfaces 216 and 218 extending from lower surface 152 of cam disk 148 and converging toward each other. Camming surfaces 216 and 218 converge at and are interconnected by apex 220.

Outer surface 152 of cam disk 148 further includes an inner camming element 222. Inner camming element 222 includes first and second sliding surfaces 224 and 226, respectively, which extend from lower surface 152. Camming surfaces 224 and 226 are circumferentially spaced from each other at a predetermined radial distance from the center of cam disk 148. The radial distance of camming surfaces 224 and 226 from the center of cam disk 148 is less than the radial distance of camming elements 206 and 208 from the center of cam disk 148. The terminal ends of camming surfaces 224 and 226 are interconnected by land 228. Land 228 is partially defined by a generally C-shaped sidewall 230 extending from outer surface 152 of cam disk 148 at a predetermined radial distance. Outer periphery 154 of cam disk 148 and sidewall 230 partially define path 232 therebetween for switch 234, FIG. 3, as hereinafter described. Land 228 is further defined by sidewall 236 projecting from outer surface 152 of cam disk 148 at a predetermined radial distance. Sidewall 234 and inwardly directed surface 238 of camming element 206 partially define path 240 therebetween for switch 242, FIG. 3, for reasons hereinafter described.

Referring to FIG. 2, transfer switch 10 further includes bracket 244. Bracket 244 is defined by an outer frame 246 having first and second sides 248 and 250, respectively, and first and second ends 252 and 254, respectively. Tabs 256 and 258 project the midpoints of corresponding ends 252 and 254, respectively, toward the interior of frame 246. In addition, tabs 260 and 262 project from the midpoints of sides 248 and 250, respectively, toward the interior of frame 246. Mounting tabs 264 and 266 project outwardly from side 248 of frame 246 and are positioned adjacent corresponding ends 252 and 254 of frame 246. Apertures 264*a* and 266*a* extend through corresponding mounting tabs 264 and 266 to facilitate the mounting of bracket 244 to base 30, which is hereinafter described. As best seen in FIG. 2, the terminal ends of tabs 256, 258, 260, and 262 define an opening for receiving locking bar 268 therebetween. Locking bar 268 includes first and second switching elements 270 and 272 projecting therefrom for reasons hereinafter described.

In order to assemble transfer switch 10, motor 204 is attached to the underside of base 130. In addition, circuit board 280 having circuit 282 is interconnected to the underside of base 230 such that switches 234 and 242 project into opening 84 through recessed surface 80. Thereafter, base 30 is positioned such that sidewall 42 abuts circuit breakers 14 and 26. Feet 54 and 56 of leg structure 44 and feet 72 and 74 of leg structure 46 are interconnected to the upper portion of panel 12. Bracket 244 is positioned over circuit breakers 14 and 26 such that tab 256 is disposed in between the first and second housing portions 282 and 284, respectively, of circuit breaker 14 and such that tab 258 is disposed between first and second housing portions 286 and 288, respectively, of circuit breaker 26. Tabs 260 and 262 are disposed between circuit breakers 14 and 16. Thereafter, fasteners, such as screws, extend through apertures 264*a* and 266*a* in corresponding tabs 264 and 266 and interconnect bracket 244 to upper surface 82 of base 30.

With circuit breakers 14 and 26 in the off position, bar 268 is positioned between first and second housing portions 282 and 284 of circuit breaker 14 and between first and second housing portions 286 and 288, respectively, of circuit breaker 26. Switching elements 270 and 272 are spaced such that with actuator bar 14*a* of circuit breaker 14 in its on position, switching element 270 engages actuator bar 14*a* of circuit breaker 14. In addition, switching element 272 of locking bar 278 maintains actuator bar 26*a* of circuit breaker 26 in its off position. When actuator bar 26*a* of circuit breaker 26 is moved to the on position, switching element 270 of locking bar 268 engages actuator bar 14*a* of circuit breaker 14 and moves actuator bar 14*a* to its off position. In such manner, circuit breakers 14 and 26 cannot be simultaneously in their on positions.

As described, with transfer switch 10 mounted to panel 12, terminal end 112 of second leg 106 of operating arm 88 engages actuator bar 14*a* of circuit breaker 14. Likewise, terminal end 134 of second leg 128 of operating arm 90 engages actuator bar 26*a* of circuit breaker 26. It can be appreciated that by selectively pivoting operating arms 88 and 90 on corresponding pivot pins 136 and 138, operating arms 88 and 90 selectively move corresponding actuator bars 14*a* and 26*a* of circuit breakers 14 and 26 to their on positions.

In order to selectively pivot operating arms 88 and 90 in order to actuate circuit breakers 14 and 26, as hereinafter described, it is contemplated to utilize arm 156. More specifically, as best seen in FIGS. 7-10, the rotation of cam disk 148 causes bearing 172 of arm 156 to sequentially engage first side 100 of first leg 98 of operating arm 88 and first side 122 of first leg 120 of operating arm 90. As hereinafter described, actuation of motor 204, and hence rotation of cam disk 148 and arm 156 attached thereto, is controlled by circuit 282 provided on circuit board 280.

Figure 11:
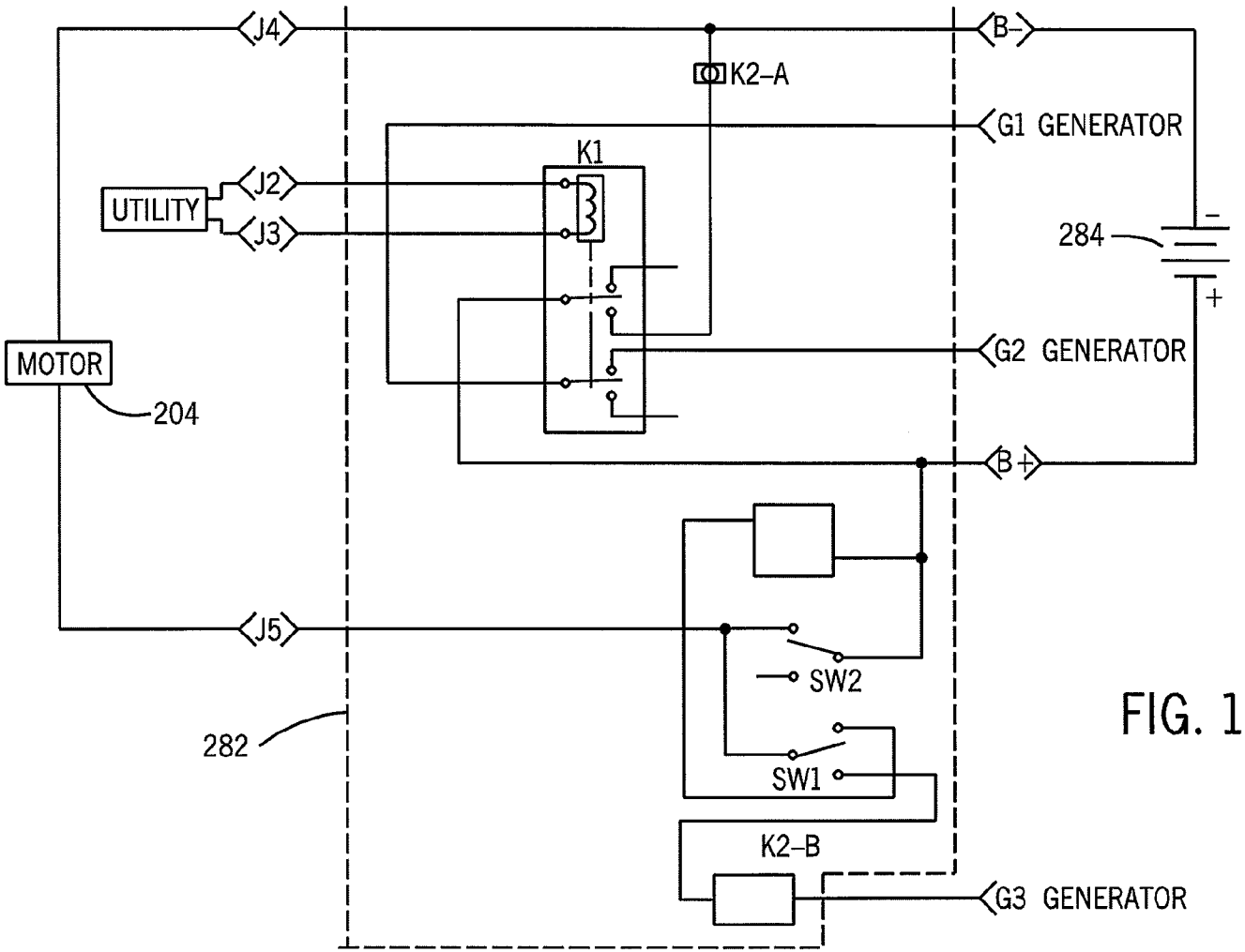
FIG. 11 is a schematic diagram of a circuit for the transfer switch of the present invention.
Figure 12:
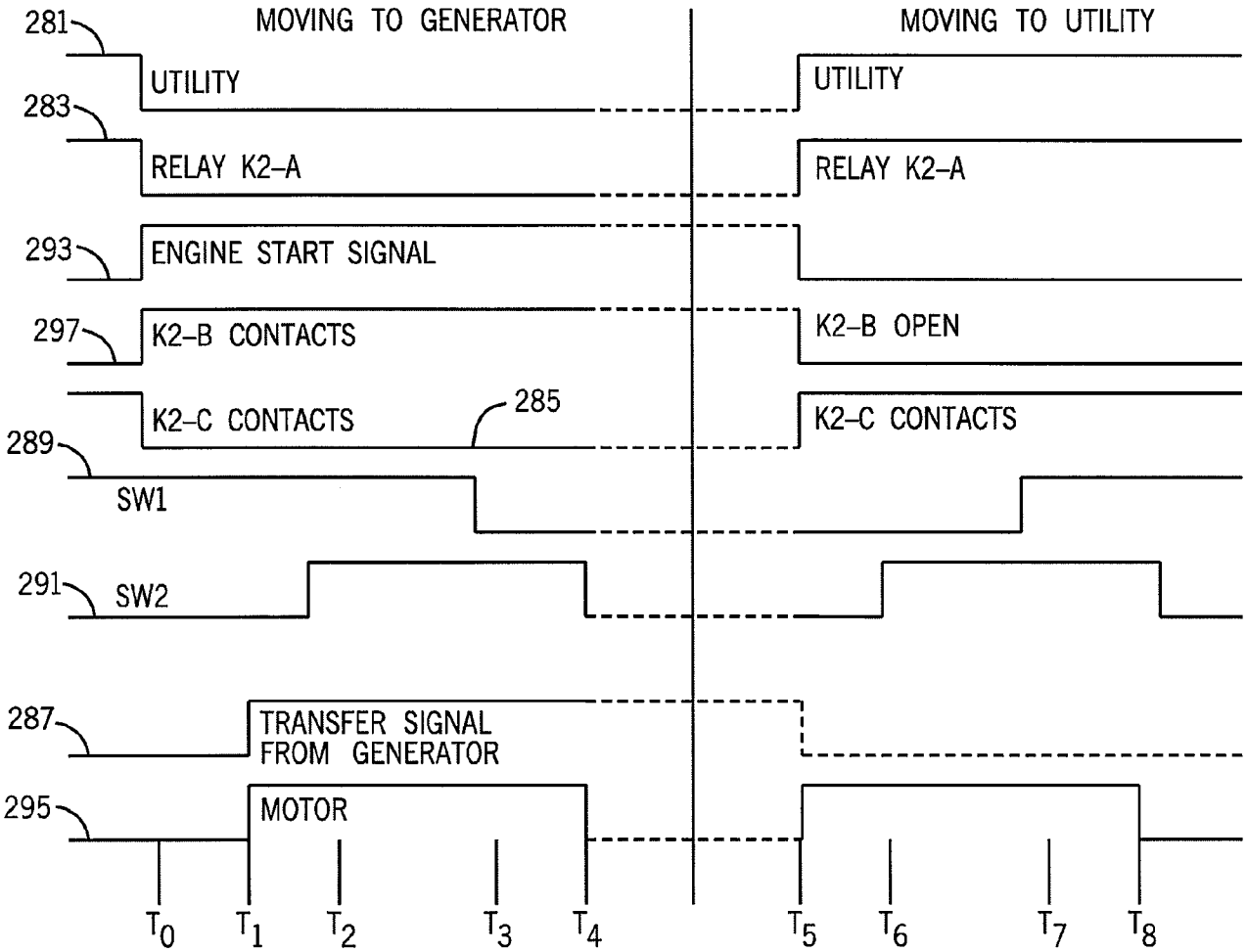
FIG. 12 is a timing diagram for the circuit of FIG. 11.

Referring to FIGS. 11-12, in its initial configuration, utility is connected to relay K1 at terminals J2 and J3 of circuit 282. Terminals J4 and J5 of circuit 282 are connected to motor 204 and terminals B− and B+ are connected to battery 284. Terminals G1 and G2 of circuit 282 are connected to provide signals to a conventional standby electrical generator and terminal G3 of circuit 282 is also connected to the standby electrical generator to receive signals therefrom.

With arm 156 in its initial state, at the 6 o'clock position in FIGS. 7-10, circuit breaker 14 is in the on position and circuit breaker 26 is in the off position. With arm 156 in its initial state, switch 242, line 289, is closed by land 228 and switch 234 is in an open position. As a result, electricity flows from the utility, line 281, though circuit breaker 14, to first and second essential hot buss bars 16 and 18, respectively. With the utility supplying electrical power, relay K1 is energized thereby interconnecting terminals G1 and G2 of circuit 282. In addition, relay K2-A, line 283, is energized such that contacts K2-B, line 297, are open so as to disconnect the standby generator from circuit 282 and such that contacts K2-C, line 285, are closed so as to interconnect battery 284 to circuit 282.

In response to a power outage at the utility at an initial time $T_0$, FIG. 12, relays K1 and K2 are de-energized such that the standby electrical generator receives a start signal, line 293. In addition, contacts K2-B close so as to connect the standby electrical generator to circuit 282 at terminal G3 and contacts K2-C open so as to disconnect battery 284 from circuit 282. At a predetermined time T1, the standby electrical generator provides a signal, line 287, at terminal G3 of circuit 282 so as to actuate motor 204, line 295. As motor 204 rotates arm 156 and cam disk 148, bearing 172 of arm 156 engages first side 122 of first leg 120 of operating arm 90 so as urge operating arm 90 counter-clockwise in FIGS. 7-10.

As motor 204 rotates cam disk 148, camming element 206 engages and close switch 234, line 291, at time $T_2$. Simultaneously, as operating arm 90 is urged counter-clockwise, terminal end 134 of second leg 128 of operating arm 90 engages actuator bar 26*a* of circuit breaker 26 and urges actuator bar 26*a* to the on position. In addition, locking bar 268 through switching elements 270 and 272 translates movement of actuator bar 26*a* to actuator bar 14*a* of circuit breaker 14 such than circuit breaker 14 is moved to the off position. As a result, first and second essential hot buss bars 16 and 18, respectively, are disconnected from the utility and interconnected to the output of the standby electrical generator though circuit breaker 26.

Motor 204 continues to rotate cam disk 148 such that land 228 disengages from switch 242 such that switch 242 opens at time $T_3$. With switch 242 open, the signal from the standby electrical generator is isolated from circuit 282 so as to stop actuation of motor 204. With motor 204 stopped, arm 156 is stopped at the 12 o'clock position in FIGS. 7-10 at time $T_4$. As a result, standby electrical generator provides electricity to first and second essential hot buss bars 16 and 18, respectively, through circuit breaker 26.

In response to a return of power from the utility at time $T_5$, FIG. 12, relays K1 and K2 are energized such that the start signal to the standby electrical generator is terminated. In addition, contacts K2-B open so as to disconnect the standby electrical generator from circuit 282 at terminal G3 and contacts K2-C close so as to interconnect battery 284 to circuit 282. With battery 284 connected to circuit 282, motor 204 rotates arm 156 and cam disk 148 such that bearing 172 of arm 156 engages first side 100 of first leg 98 of operating arm 88 so as urge operating arm 88 counterclockwise in FIGS. 7-10. At a predetermined time $T_5$, the signal from the standby electrical generator at terminal G3 of circuit 282 is terminated.

As motor 204 rotates cam disk 148, camming element 208 engages and closes switch 234 at time $T_6$. Simultaneously, as operating arm 88 is urged counterclockwise, terminal end 112 of second leg 106 of operating arm 88 engages actuator bar 14*a* of circuit breaker 14 and urges actuator bar 14*a* to the on position. In addition, locking bar 268 through switching elements 270 and 272 translates movement of actuator bar 14*a* to actuator bar 26*a* of circuit breaker 26 such than circuit breaker 26 is moved to the off position. As a result, first and second essential hot buss bars 16 and 18, respectively, are disconnected from the standby electrical generator and are reconnected to the utility source though circuit breaker 14.

Motor 204 continues to rotate cam disk 148 such that land 228 engages switch 242 such that switch 242 closes at time $T_7$. Thereafter, camming element 208 disengages and opens switch 234 at time $T_8$. With switch 234 open, the signal from the battery is isolated from circuit 282 so as to stop actuation of motor 204. With motor 204 stopped, arm 156 is stopped at the 6 o'clock position in FIGS. 7-10. Thereafter, the process can be repeated.

Various modes of carrying out the invention are contemplated as being within the scope of the following claims particularly pointing and distinctly claiming the subject matter that is regarded as the invention.

We claim:

1. A transfer switch for transferring a supply of electrical power to a load between a utility source and a generator that generates electrical power when started, the load interconnected to the utility source through a first circuit breaker and to the generator through a second circuit breaker, each of the circuit breakers movable between an on position and an off position, the transfer switch comprising:

a first arm movable between a first position and a second position wherein the first arm is engageable with the first circuit breaker for moving the first circuit breaker from the off position to the on position;

a second arm movable between a first position and a second position engageable with the second circuit breaker for moving the second circuit breaker from the off position to the on position;

a control structure for urging the first and second arms to the second positions;

a bar extending between the first and second circuit breakers, the bar moving the second circuit breaker to the off position when the first circuit breaker moves to the on position and moving the first circuit breaker to the off position when the second circuit breaker moves to the on position;

wherein:

the control structure includes a rotatable arm selectively engageable with one of the first and second arms to move the one of the first and second arms to the second position; and the rotatable arm is axially movable between a retracted position and an extended position and wherein the control structure includes a biasing structure for urging the rotatable arm towards the extended position.

2. The transfer switch of claim 1 wherein the rotatable arm includes a terminal end and a bearing rotatably mounted to the terminal end of the rotatable arm, the bearing engageable with the first and second arms.

3. The transfer switch of claim 1 wherein the control structure includes a motor operatively connected to the rotatable arm for rotating the arm.

4. The transfer switch of claim 3 wherein the control structure includes a controller operatively connected to the generator, the controller actuating the motor in response to a command from the generator.

5. The transfer switch of claim 4 wherein the controller includes first and second switches movable between off positions and on positions, the positions of the switches controlling actuation of the motor.

6. The transfer switch of claim 5 wherein the control structure includes a cam disk disposed between the rotatable arm and the first and second switches, the cam disk including a first camming surface engageable with the first switch for actuating the first switch.

7. The transfer switch of claim 6 wherein the cam disk includes a second camming surface engageable with the second switch for actuating the second switch.

8. A transfer switch for transferring a supply of electrical power to a load between a utility source and a generator that generates electrical power when started, the load interconnected to the utility source through a first circuit breaker and to the generator through a second circuit breaker, each of the circuit breakers movable between an on position and an off position, the transfer switch comprising:

a first arm movable between a first position and a second position wherein the first arm is engageable with the first circuit breaker for moving the first circuit breaker from the off position to the on position;

a second arm movable between a first position and a second position engageable with the second circuit breaker for moving the second circuit breaker from the off position to the on position;

a bar extending between the first and second circuit breakers, the bar moving the second circuit breaker to the off position when the first circuit breaker moves to the on position and moving the first circuit breaker to the off position when the second circuit breaker moves to the on position; and a rotatable arm selectively engageable with one of the first and second arms to move the one of the first and second arms to the second position;

the rotatable arm being axially movable between a retracted position and an extended position;

wherein the transfer switch includes a biasing structure for urging the rotatable arm towards the extended position.

9. The transfer switch of claim 8 further comprising a motor operatively connected to the rotatable arm for rotating the arm.

10. The transfer switch of claim 9 further comprising a controller operatively connected to the generator, the controller actuating the motor in response to a command from the generator.

11. The transfer switch of claim 10 wherein the controller includes first and second switches movable between off positions and on positions, the positions of the switches controlling actuation of the motor.

12. The transfer switch of claim 11 further comprising a cam disk disposed between the rotatable arm and the first and second switches, the cam disk including a first camming surface engageable with the first switch for actuating the first switch.

13. The transfer switch of claim 12 wherein the cam disk includes a second camming surface engageable with the second switch for actuating the second switch.

14. A transfer switch for transferring a supply of electrical power to a load between a utility source and a generator that generates electrical power when started, the load interconnected to the utility source through a first circuit breaker and to the generator through a second circuit breaker, each of the circuit breakers movable between an on position and an off position, the transfer switch comprising:

a first arm movable between a first position and a second position wherein the first arm is engageable with the first circuit breaker for moving the first circuit breaker from the off position to the on position;

a second arm movable between a first position and a second position engageable with the second circuit breaker for moving the second circuit breaker from the off position to the on position;

a rotatable arm selectively engageable with one of the first and second arms to move the one of the first and second arms to the second position;

a motor operatively connected to the rotatable arm for rotating the arm;

a motor control operatively connected to the motor for actuating the motor; and an actuation element operatively connected to the rotatable arm, the actuation element communicating with the motor control for controlling actuation of the motor;

wherein the rotatable arm is axially movable between a retracted position and an extended position and wherein the control structure includes a biasing structure for urging the rotatable arm towards the extended position.

15. The transfer switch of claim 14 further comprising a bar extending between the first and second circuit breakers, the bar moving the second circuit breaker to the off position when the first circuit breaker moves to the on position and moving the first circuit breaker to the off position when the second circuit breaker moves to the on position.

16. The transfer switch of claim 14 further comprising first and second switches operatively connected to the motor controller and being movable between off positions and on positions, the positions of the switches controlling actuation of the motor.

17. The transfer switch of claim 16 wherein the actuation element includes at least one camming surface engageable with at least one switch for moving the at least one switch between the off position and the on position.

18. A transfer switch for transferring a supply of electrical power to a load between a utility source and a generator that generates electrical power when started, the load interconnected to the utility source through a first circuit breaker and to the generator through a second circuit breaker, each of the circuit breakers movable between an on position and an off position, the transfer switch comprising:

a first arm movable between a first position and a second position wherein the first arm is engageable with the first circuit breaker for moving the first circuit breaker from the off position to the on position;

a second arm movable between a first position and a second position engageable with the second circuit breaker for moving the second circuit breaker from the off position to the on position;

a control structure for urging the first and second arms to the second positions; and a bar extending between the first and second circuit breakers, the bar moving the second circuit breaker to the off position when the first circuit breaker moves to the on position and moving the first circuit breaker to the off position when the second circuit breaker moves to the on position;

wherein:

the control structure includes a rotatable arm selectively engageable with one of the first and second arms to move the one of the first and second arms to the second position; and the rotating arm includes a terminal end and a bearing rotatably mounted to the terminal end of the rotatable arm, the bearing engageable with the first and second arms.

19. A transfer switch for transferring a supply of electrical power to a load between a utility source and a generator that generates electrical power when started, the load interconnected to the utility source through a first circuit breaker and to the generator through a second circuit breaker, each of the circuit breakers movable between an on position and an off position, the transfer switch comprising:

a first arm movable between a first position and a second position wherein the first arm is engageable with the first circuit breaker for moving the first circuit breaker from the off position to the on position;

a second arm movable between a first position and a second position engageable with the second circuit breaker for moving the second circuit breaker from the off position to the on position;

a bar extending between the first and second circuit breakers, the bar moving the second circuit breaker to the off position when the first circuit breaker moves to the on position and moving the first circuit breaker to the off position when the second circuit breaker moves to the on position; and a rotatable arm selectively engageable with one of the first and second arms to move the one of the first and second arms to the second position, the rotatable arm including a terminal end and a bearing rotatably mounted to the terminal end of the rotatable arm, the bearing engageable with the first and second arms.

20. A transfer switch for transferring the supply of electrical power to a load between a utility source and a generator that generates electrical power when started, the load interconnected to the utility source through a first circuit breaker and to the generator through a second circuit breaker, each of the circuit breakers movable between an on position and an off position, the transfer switch comprising:

a first arm movable between a first position and a second position wherein the first arm is engageable with the first circuit breaker for moving the first circuit breaker from the off position to the on position;

a second arm movable between a first position and a second position engageable with the second circuit breaker for moving the second circuit breaker from the off position to the on position;

a rotatable arm selectively engageable with one of the first and second arms to move the one of the first and second arms to the second position;

a motor operatively connected to rotatable arm for rotating the arm; and a motor control operatively connected to the motor for actuating the motor;

an actuation element operatively connected to the rotatable arm, the actuation element communicating with the motor control for controlling actuation of the motor;

wherein:

the rotatable arm is axially movable between a retracted position and an extended position;

the control structure includes a biasing structure for urging the rotatable arm towards the extended position; and the rotatable arm includes a terminal end and a bearing rotatably mounted to the terminal end of the rotatable arm, the bearing engageable with the first and second arms.

21. A transfer switch for transferring a supply of electrical power to a load between a utility source and a generator that generates electrical power when started, the load interconnected to the utility source through a first circuit breaker and to the generator through a second circuit breaker, each of the circuit breakers movable between an on position and an off position, the transfer switch comprising:

a first arm movable between a first position and a second position wherein the first arm is engageable with the first circuit breaker for moving the first circuit breaker from the off position to the on position;

a second arm movable between a first position and a second position engageable with the second circuit breaker for moving the second circuit breaker from the off position to the on position; and a control structure for urging the first and second arms to the second position, the control structure including a rotatable arm selectively engageable with one of the first and second arms to move the one of the first and second arms to the second position;

a motor operatively connected to the rotatable arm for rotating the arm;

first and second switches movable between off positions and on positions, the positions of the switches controlling actuation of the motor;

a cam disk operatively connected to the rotating arm for rotational movement therewith, the cam disk including a first camming surface engageable with the first switch for actuating the first switch and a second camming surface engageable with the second switch for actuating the second switch.

22. The transfer switch of claim 21 further comprising a bar extending between the first and second circuit breakers, the bar moving the second circuit breaker to the off position when the first circuit breaker moves to the on position and moving the first circuit breaker to the off position when the second circuit breaker moves to the on position.

23. The transfer switch of claim 21 wherein the rotatable arm is axially movable between a retracted position and an extended position and wherein the control structure includes a biasing structure for urging the rotatable arm towards the extended position.

24. The transfer switch of claim 21 wherein the rotating arm includes a terminal end and a bearing rotatably mounted to the terminal end of the rotatable arm, the bearing engageable with the first and second arms.

* * * * *